US005993265A

United States Patent [19]

Daoud

[11] Patent Number: 5,993,265

[45] Date of Patent: Nov. 30, 1999

[54] CUSTOMER BRIDGE MOUNTABLE ON EITHER A PRINTED CIRCUIT OR SHEET METAL PANEL

[75] Inventor: Bassel H. Daoud, Parsippany, N.J.

[73] Assignee: Lucent Technologies, Inc., Murray Hill, N.J.

[21] Appl. No.: 09/107,751

[22] Filed: Jun. 30, 1998

[51] Int. Cl.[6] ..... H01R 23/02

[52] U.S. Cl. ..... 439/676; 379/399

[58] Field of Search ..... 439/676, 409, 439/410, 417, 412, 413; 379/399, 438, 332

[56] References Cited

U.S. PATENT DOCUMENTS

| | | | |
|---|---|---|---|
| 4,396,809 | 8/1983 | Brunssen | 179/175 |
| 4,874,329 | 10/1989 | Yu | 439/409 |
| 4,913,659 | 4/1990 | Doyle | 439/395 |
| 5,004,433 | 4/1991 | Daoud | 439/502 |
| 5,222,908 | 6/1993 | Baker, III et al. | 439/557 |
| 5,240,432 | 8/1993 | Daoud | 439/417 |
| 5,562,478 | 10/1996 | Yamamoto | 439/417 |
| 5,681,182 | 10/1997 | Reichle | 439/417 |
| 5,721,396 | 2/1998 | Daoud | 174/59 |
| 5,740,685 | 4/1998 | Daoud | 70/164 |

OTHER PUBLICATIONS

Egerton, Advertisment entitled "Mini–Rocker Cross Connect".

*Primary Examiner*—Neil Abrams

*Assistant Examiner*—Javaid Nasri

*Attorney, Agent, or Firm*—Duane, Morris & Heckscher LLP; Steven E. Koffs

[57] ABSTRACT

A device (100) has a base (112). The base (112) has a first jack (161) on its bottom and a second jack (153) on its top. The first jack (161) may be a standard 645-type jack, and the second jack (153) may be a standard RJ11 jack. The base (112) has a bearing surface (114) for engaging a mounting surface (198) of a standard sheet metal panel. A first plug (160) (such as a 645-type plug) is shaped to fit into the first jack (161). The first plug (160) has terminals (164) which are conductively coupled to the second jack (153). The terminals (164) are shaped so as to directly connect to a printed circuit (199*a*) when the bearing surface (114) of the base (112) engages the mounting surface (198) and the mounting surface is positioned between the bearing surface and the printed circuit. A second plug (152), which may be an RJ11 plug, is shaped to fit into the second jack (153). The second plug (152) has contacts (154) which are conductively coupled to the printed circuit (199*a*) via the first plug (160) when the second plug is inserted in the second jack (153). The second plug (152) may be attached to the base (112) by a flexible attachment, which may be, for example, a cable (130) or a hinge (270). In one example, the base (212) and the second plug (252) are formed by a single portion of material, and are attached to each other by a living hinge (270).

24 Claims, 4 Drawing Sheets

CUSTOMER BRIDGE MOUNTABLE ON EITHER A PRINTED CIRCUIT OR SHEET METAL PANEL

FIELD OF THE INVENTION

The present invention relates to network interfaces for telecommunications equipment.

BACKGROUND OF THE INVENTION

Most modem multi-occupant buildings have a network interface unit, which includes a plurality of customer bridges. Each customer bridge provides an interface between the external telephone network lines and the internal lines of an individual customer. The bridge typically includes a standard RJ11 jack that is attached to an output wire termination connector through an RJ11 plug/cord assembly.

The customer bridge assemblies are typically mounted to a sheet metal panel, and then each bridge is connected to the external telephone lines by manually running wires behind the panel. This is a time consuming, labor intensive procedure.

An alternative design has eliminated the mounting panel, and instead has used a printed circuit board (PCB) instead of wires. For example, an insulation displacement connector (IDC) has been used having PCB type terminals on its bottom, and lead-wire receptacles at its top. The connector is seated directly on the PCB, with its bottom terminals forming an electrical connection to the printed circuit on the PCB (for example, using plated through-holes or vias). This solution, however, leaves much to be desired. If the diameter of the bottom terminals is too large, the diameter of the vias too small, or the terminals are not precisely aligned with the vias, force may be required to seat the terminals in the vias. If force is applied to seat the bottom terminals into the PCB, the PCB may flex, damaging the fragile printed circuit paths. If the connector is pulled, it may fall out of the PCB and become lost.

SUMMARY OF THE INVENTION

The present invention is a customer bridge housing that is mountable to either an interface panel, a PCB, or both in a single installation. The invention also includes a method for mounting the customer bridge housing to the panel and the PCB simultaneously.

The device includes a base having a first jack on its bottom, and a second jack on its top. The base has a bearing surface for engaging a mounting surface.

A first plug is shaped to fit into the first jack. The first plug has two sets of terminals: upper terminals and bottom terminals The upper terminals are conductively coupled to the bottom set of terminals, which are in turn conductively coupled to the second jack The bottom terminals are shaped so as to directly connect to a printed circuit on a PCB, when the bearing surface of the base engages the mounting surface, and the mounting surface is positioned between the bearing surface and the printed circuit.

The base may have one or more integrally attached spacers on its bottom. The spacers maintain a predetermined distance between the mounting surface and the printed circuit. The spacers may include means for attaching the base to the PCB on which the printed circuit is located.

These and other aspects of the invention are described in detail below with reference to the drawings and the description of the exemplary embodiments.

DETAILED DESCRIPTION

Figure 1A:
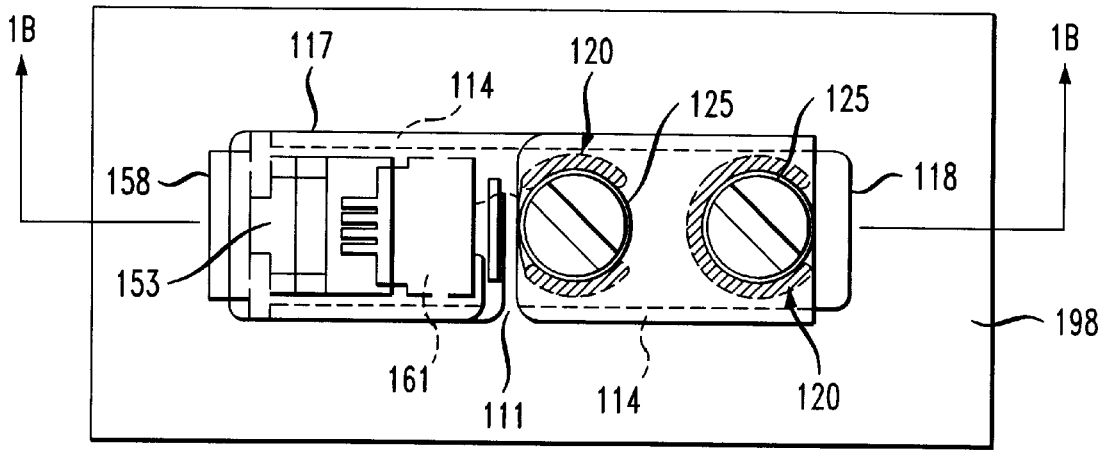
FIG. 1A is a plan view of a first exemplary device according to the invention.
Figure 1B:
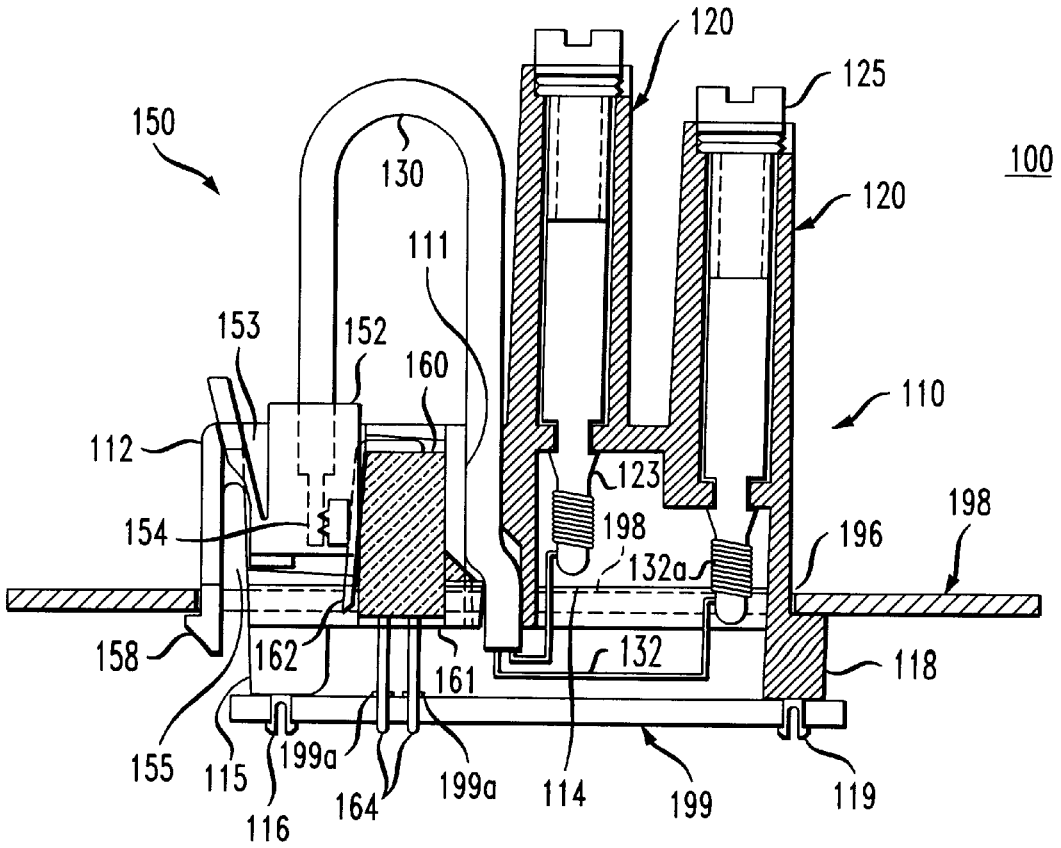
FIG. 1B is a cross-sectional view of the exemplary embodiment of FIG. 1A mounted simultaneously to a panel and to a PCB, the view taken along section line 1B—1B.

FIGS. 1A and 1B show an exemplary device 100 according to the invention. The device 100 includes a base 112 having a first jack 161 (which may be, for example, a 645 type jack) on its bottom, and a second jack 153 (which may be, for example, an RJ11 jack) on its top. The base 112 has a bearing surface 114 for engaging a mounting surface 198. Mounting surface 198 may be, for example, the top surface of a standard sheet metal panel for a network interface.

A first plug 160 is shaped to fit into the first jack 161. The first plug 160 has two sets of terminals: upper terminals 162 and bottom terminals 164. The upper terminals 162 are conductively coupled to the bottom set of terminals 162, which are in turn conductively coupled to the second jack 153. The bottom terminals 164 are shaped so as to directly connect to a printed circuit 199*a* on PCB 199, when the bearing surface 114 of base 112 engages the mounting surface 198, and the mounting surface 198 is positioned between the bearing surface 114 and the printed circuit 199*a*.

The base 112 may have one or more integrally attached spacers 115, 118 on its bottom. The spacers 115, 118 maintain a predetermined distance between the mounting surface 198 and the printed circuit 199*a*. A spacer 115 may, for example, be formed by a bottom surface of the second jack 153. A spacer 118 may be formed at either end of the base 112. The spacers 115, 118 may include means 116, 119 for attaching the base 112 to the PCB 199 on which the printed circuit 199*a* is located.

A second plug 152, is shaped to fit into the second jack 153. The second plug has contacts 154 which are conductively coupled to the printed circuit 199*a* via the first plug 160 when the second plug 152 is inserted in the second jack 153. The second plug 152 has a flexible attachment 130 to the base 112, which allows the second plug 152 to be removed from the second jack 153 while the second plug 152 is still attached to the base 112.

FIGS. 1A–1D show a first aspect of the invention. The invention includes a multi-purpose base 112 for a customer bridge assembly. Base 112 may be mounted to a sheet metal panel 198 having standard sized openings 196 for receiving customer bridge assemblies. Base 112 may be mounted directly to a printed circuit board (PCB) 199. According to a further aspect in the invention, base 112 may simultaneously be mounted both to the standard opening of a panel 198 and to the printed circuit board 199.

Figure 1C:
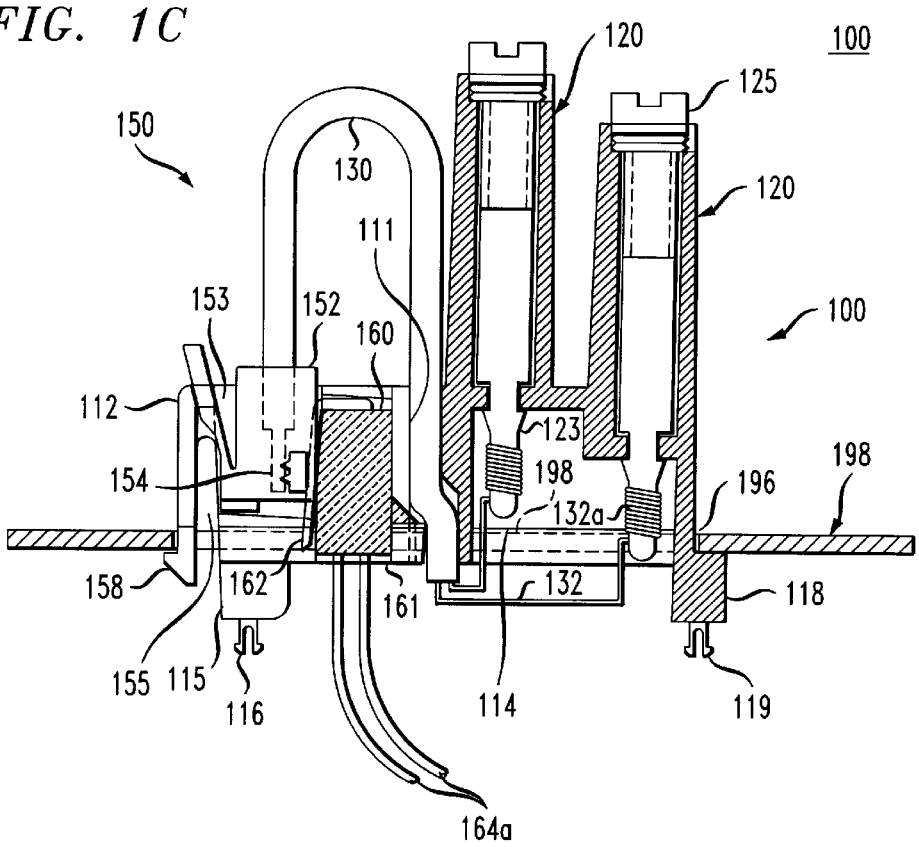
FIG. 1C is a cross-sectional view of the exemplary embodiment of FIG. 1A mounted to a panel, the view taken along section line 1B—1B.

FIG. 1C shows the base 112 mounted to a standard opening of a sheet metal panel 198. Base 112 includes bearing surfaces 114 along at least 2 sides of base 112. In the exemplary embodiment, bearing surfaces 114 extend across the length of base 112 and form a pair of downward facing ledges which rest on opposite sides of the opening 196 in the standard panel 198. Bearing surfaces 114 limit the downward movement of base 112, so that base 112 cannot extend further downward relative to panel 198. Base 112 further includes a fastening mechanism, which may be, for example, latch 158, with a spacer 118 on an end of base 112 opposite the latch 158. Latch 158 and spacer 118 prevent upward movement of base 112 relative to panel 198 and further prevent lengthwise movement in the horizontal plane parallel to the length of base 112. The combination of latch 158, spacer 118 and bearing surfaces 114 are sufficient to secure base 112 to a panel 198 as shown in FIG. 1C. Using the configuration shown in FIG. 1C, bridge assembly 100 may be connected to the external telephone system, using a conventional type-645 connector 160. The 645 connector 160 includes conventional wiring 164*a* to connect the bridge circuit to the external telephone network (not shown).

Figure 1D:
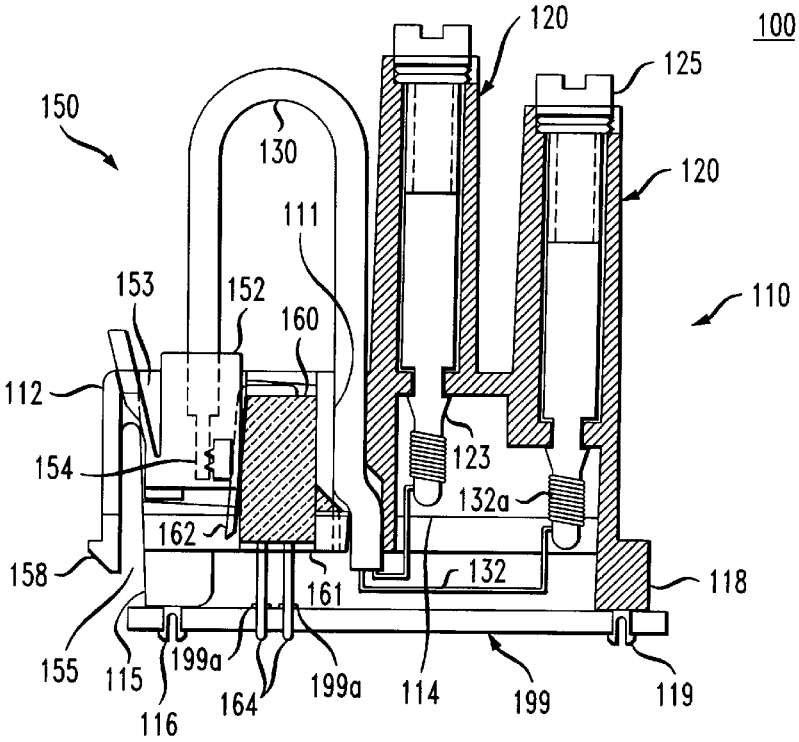
FIG. 1D is a front elevation view of the exemplary embodiment of FIG. 1A, mounted to a PCB.

Alternatively, as best shown in FIG. 1D, base 112 may be mounted directly to a PC board 199. Base 112 includes means for mounting the base directly to PC board 199. This mounting means may, for example, include latches 116 and 119. One of ordinary skill in the art recognizes that latches 116 and 119 are only exemplary in nature, and other fastener types may be used, such as bolts, clamps, hooks, pins, etc. According to a further aspect of the invention, base 112 may include spacers 115 and 118 for maintaining a predetermined separation between a bridge and PCB 199. In the exemplary embodiment, spacer 115 is attached to a jack portion 153 of the base 112, and spacer 118 is the same member which serves to prevent upward motion of base 112 when the base is mounted to a panel 198 (FIG. 1B). This configuration reduces the weight and the amount of material required for the device.

One of ordinary skill recognizes that in a further exemplary embodiment (not shown), the spacers may be separate and distinct from the jack portion 153 of the base 112 and the latch 158, and spacer 118 although additional material may be required.

When assembly 100 is mounted directly to PCB 199, an electrical connection is formed directly between the network interface device (NID) 150 and a printed circuit 199*a* on PCB 199.

In the exemplary embodiment, NID 150 is coupled to circuit 199*a* by way of the 645-type plug 160, in which the bottom lead wires 164*a* are replaced by printed circuit type terminals 164. One of ordinary skill in the art recognizes that an electrical connection may be formed between terminals 164 and the printed circuit 199*a* by way of conventional connections which may include plated through-holes, eyelets, etc.

Referring again to FIG. 1B, an exemplary configuration of the present invention is shown. In FIG. 1B, the exemplary housing 112 is connected to both the panel 198 and the PCB 199 simultaneously. The configuration shown in FIG. 1B has the ease of installation provided by the PC mount shown in FIG. 1D. Further, the mounting of FIG. 1B advantageously protects PCB 199, because bearing surface 114 prevents base 112 from being pushed towards PCB 199 beyond a pre-determined allowable position. Once bearing surface 114 rests against the edge of panel 198, any additional force applied downward on base 112 is only transmitted as a stress on panel 198. The force is not transmitted to PCB 199. Nevertheless, the configuration of FIG. 1B has the same speed of mounting that was previously only available with a PCB mounting. The step of manually running wires 164*a* is eliminated.

Customer bridge 100 includes further advantageous features which are described below. According to a further aspect of the invention, the single base 112 is provided to include both the NID 150 and the customer connector assembly 110.

Network interface device 150 includes a compact configuration as shown. The wires coming from the external telephone network terminate at PCB 199. NID 150 receives a standard 645 type plug 160. Plug 160 is inserted into a standard 645-type jack 161 in the bottom of base 112. A standard RJ11 type jack 153 is provided on the top surface of base 112. In the exemplary embodiment, there is no wall separating 645-typejack 161 from RJ11 jack 153. When an RJ11 plug 152 is inserted into jack 153, and a 645 plug 160 is inserted into type-645 jack 161, the terminals 162 of the type-645 jack 160 engage the conductor 154 of the RJ11 plug 152, thus establishing an electrical connection between the external telephone network and RJ11 plug 152. The combined footprint of the 645-type plug 160 and the RJ11 plug 152 is about 1.25 centimeters (0.5 inches).

One of ordinary skill recognizes that an intermediate portion of conductive material (not shown) could be placed between the 645-type plug 160 and the RJ11 plug 152 without substantially changing the function or operation of the assembly. However, this would add weight to the assembly, and increase its footprint.

RJ11 plug 152 is connected to a cable 130 having standard tip and ring wires 132. Cable 130 provides a simple means to connect the customer interface 110 with NID 150. During normal operation, RJ11 plug 152 is inserted into RJ11 jack 153. Plug 152 may be removed, in order to test the network connection (i.e., by inserting the plug of a standard telephone device into jack 153). Similarly, plug 152 may be removed any time that it is necessary to perform work on the customer interface 110. This protects a human handling the wires in the customer interface 110, in the event of an abnormal high-voltage condition, which may occur if above ground telephone wires are struck by lightening.

NID 150 is separated from the customer connector assembly 110 by a recess 111 in housing 112. Recess 111 has a portion extending from the top of base 112 and a portion extending from the bottom of base 112. The top and bottom portions of recess 111 are offset from one and other. When cable 130 is inserted into recess 111, the offset grips the cable 130 and prevents slippage of the cable. As shown in FIG. 1A, recess 111 extends from one side only (the bottom side of FIG. 1A). The other side 117 of housing 112 extends continuously along the length of housing 112. This offset-type configuration is described in greater detail in U.S. Pat. No. 5,004,433 to Daoud, which is incorporated by reference herein in its entirety.

A customer interface 110 may include any of a variety of conventional customer interface connectors. For example, conventional connectors 120 may include screws 125 for receiving customer telephone lead wires (not shown).

Alternatively, connectors 120 may be of the type shown in FIG. 4 of U.S. Pat. No. 5,004,433, which are insulation displacement connectors having vertically movable caps. Connectors 120 each have a terminal 123 to which the wires 132 of cable 130 are connected, for example, by a conventional wire wrap 132*a* as shown in FIG. 1B.

FIGS. 2A through 2F show a second exemplary embodiment according to the present invention. As is the case with the first example of FIGS. 1A to 1D, the example of FIGS. 2A through 2F include a multi-application base 212 which is adapted to be mounted to either a sheet metal panel 198, a PC board 199, or to be mounted to both the sheet metal panel 198 and the PCB 199 simultaneously. Assembly 200, however, occupies a much smaller footprint than assembly 100 (FIGS. 1A to 1D). The footprint of assembly 200 is approximately ½ the footprint of assembly 100. Rather than positioning the customer interface 220 side-by-side next to the network interface 210, the example of FIGS. 2A through 2F have the customer interface 220 positioned on top of the network interface 210.

Figure 2B:
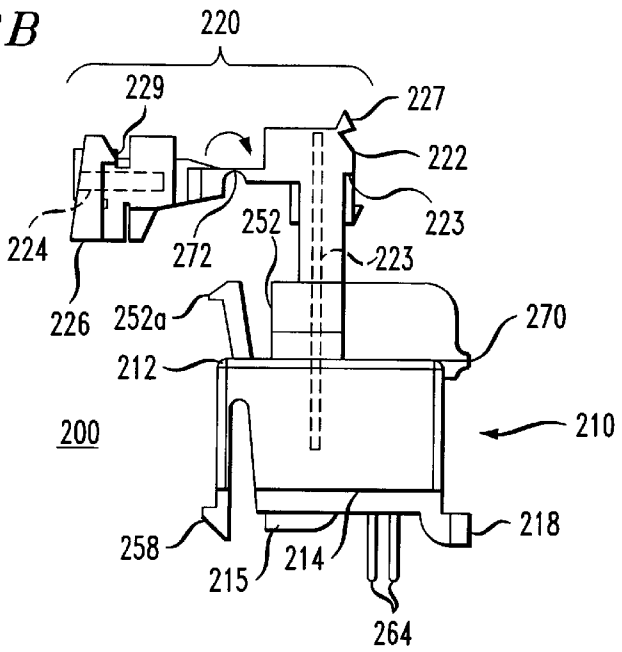
FIG. 2B is a front elevation view of the embodiment of FIG. 2A, with the RJ11 plug inserted in the RJ11 jack, and the IDC Connector in the open position.
Figure 2C:
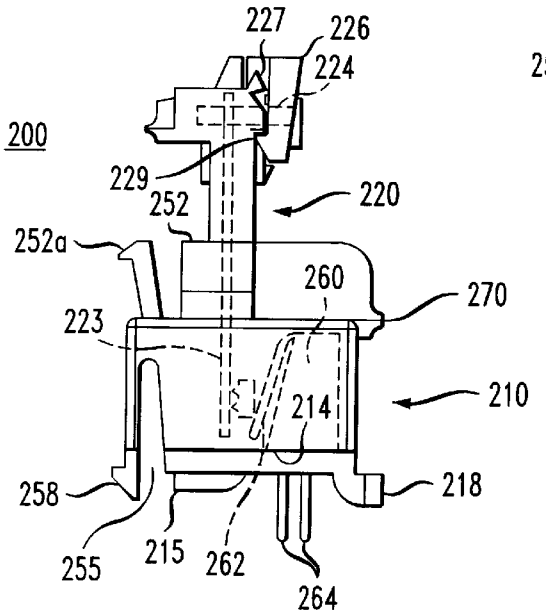
FIG. 2C is a front elevation view of the embodiment of FIGS. 2A and 2B, with the RJ11 plug inserted in the RJ11 jack, and the IDC Connector in the closed position.
Figure 2A:
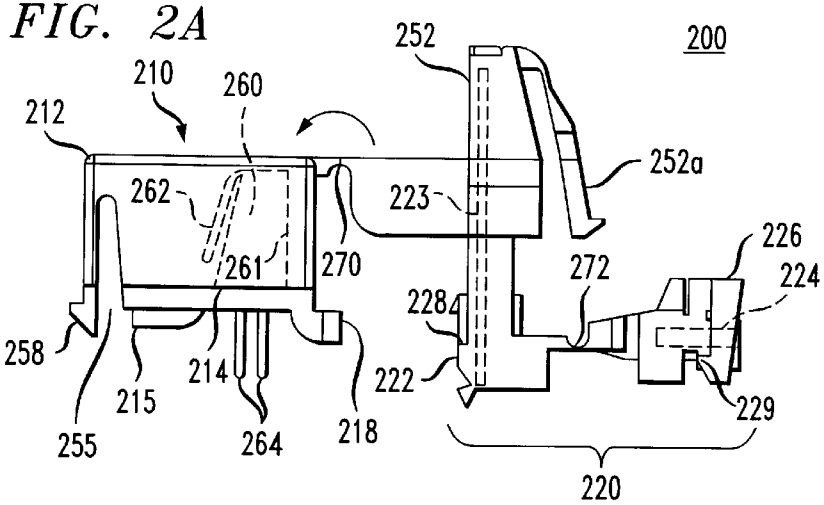
FIG. 2A. is a front elevation view of a second exemplary embodiment of the invention, in which the RJ11 plug is unplugged from the RJ11 jack, and the Insulation Displacement Connector (IDC) in the open position.

The network interface 210 is similar to the network interface 110 insofar as the relative positions of the jacks; an RJ11 jack 253 and a 645-type jack 261 (shown in phantom in FIG. 2A and positioned beneath the base 212 of assembly 200.)

Figure 2E:
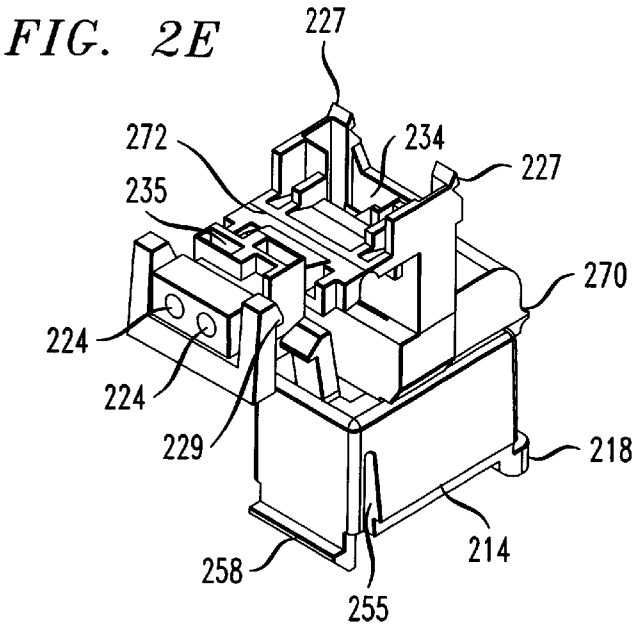
FIGS. 2D–2F are isometric views of the second embodiment of the invention, in the positions shown in FIGS. 2A–2C, respectively.

The RJ11 plug 252 of assembly 200 is integrally attached to the base 212 by a pivoting attachment 270, which may be, for example, a living hinge. Rather than connect plug 252 to the customer interface 220 by a cable (as in example 1, FIGS. 1A through 1D), a pair of terminals 223 extend from plug 252 up into the connector interface 220. In the example, terminals 223 are insulation displacement connector terminals. When plug 252 is pivoted about the living hinge 270, plug 252 fits into RJ11 jack 253 as shown in FIGS. 2B and 2E. Both the terminals 223 are omitted from FIG. 2E for simplicity in the drawing, but FIG. 2E more clearly shows the recesses 234 and 235 into which terminals 223 are seated.

Customer interface 220 is similar to an RBC2100 mini-rocker connector manufactured by the Egerton Company of Cheshire, England, except that the base of connector 220 is integrally attached to RJ11 plug 252, and extended length terminals 223 reach down to form an electrical connection with the conductors of RJ11 plug 252.

Figure 2F:
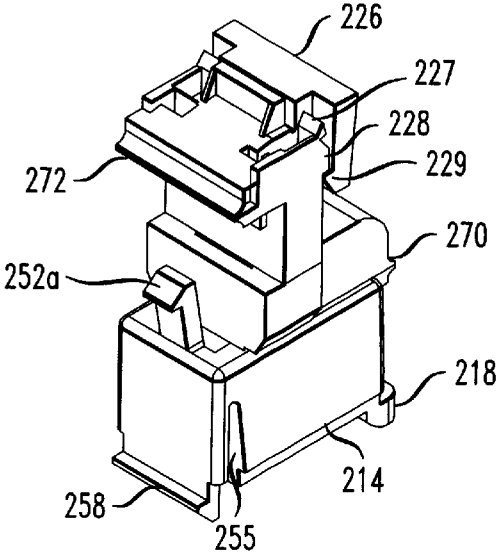
Figure 2D:
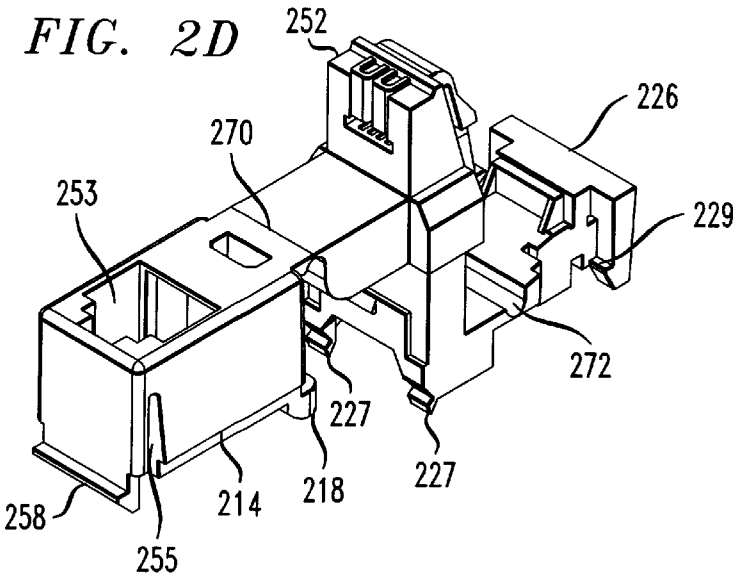

As is well known in conventional insulation displacement connectors, each of the terminals 223 includes a top portion having upwardly extending tangs for receiving the customer lead wires (not shown). Connector 220 has a top portion 226 which includes 2 lead wire holes 224. Cap 226 pivots about a pivoting joint 272, which may be a further living hinge. Cap 226 has a latch 229 which may be engaged by either one of projections 228 or 227. For example, as shown in FIGS. 2C and 2F, latch 229 is shown in engagement with bottom projection 228. Once assembled, connector 220 is normally positioned with latch 229 engaging projection 227 in the open position or projection 229 in the closed position. With connector 220 in the open position, customer lead wires may be inserted into lead wire holes 224. By pressing down on cap 226, the user causes cap 226 to pivot about living hinge 272, forcing the customer lead wires down into the tangs of terminals 223. When cap 226 reaches the closed position shown in FIGS. 2C and 2F, sufficient insulation is displaced from the customer lead wires to establish an electrical connection between the customer lead wires and terminals 223. Moreover, a conductive coupling is established between the customer lead wires and the telephone network conductors 264, by way of a path which includes terminals 223, conductor 262, 645-type plug 260 and wires 264.

One of ordinary skill in the art recognizes that the embodiment of FIGS. 2A through 2F may be formed by a single piece of material which may be, for example, an insulating plastic material, such as polypropylene or polycarbonate. In particular, if the living hinges 270 and 272 are used, it is possible to use a single piece of material such as polypropylene.

The configuration shown in FIG. 2B is advantageous because it does not require any wires between the type-645 plug 260 and the customer lead wires. Assembly is quick, requiring that the parts be pivoted with respect to each other. Further, there are no wires to measure in order to connect the work interface device 250 to the customer bridge connector 220. The configuration reduces weight and footprint, and decreases installation time.

In any event, the use of any hinge-type fastener to pivotally connect plug 252, base 212, and a second hinge-type fastener to connect cap 226 to connector 220 uses the possibility that any of the customer connector components becomes lost when plug 252 is connected, or the lead wires are disconnected from the customer connector interface 220.

Nevertheless, one of ordinary skill recognizes that a similar configuration may be constructed in which the base 212 and connector 220 are separate pieces, and are not connected by a hinge. Similarly, the cap 226 of connector 220 may be a separate piece, and need not be connected by a hinge. In some instances, this may simplify the molding of the parts, but it does increase the possibility that the parts may become separated or lost.

Further, one of ordinary skill recognizes that connector 220 may be replaced by another type of insulation displacement connector (IDC), with the bottoms of the IDC terminals extending into the plug 152, such as the IDC disclosed in U.S. Pat. No. 5,240,432 to Daoud, which is incorporated by reference herein, in its entirety. Alternatively, instead of a single cap 226, each terminal may have its own cap, which may be a cap of the type shown in U.S. Pat. No. 5,004,433 to Daoud.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A device, comprising:

a base having a first jack on a bottom of the base and a second jack on a top of the base, the base having a bearing surface for abutting a mounting surface of an interface unit to which the device is attachable; and a first plug shaped to fit into the first jack, the first plug having terminals which are conductively coupled to the second jack, said terminals being shaped so as to be directly connectable to a printed circuit when the bearing surface of the base abuts the mounting surface and the printed circuit is below the mounting surface.

2. The device according to claim 1, further comprising:

a second plug shaped to fit into the second jack, the second plug having contacts which are conductively coupled to the printed circuit via the first plug when the second plug is inserted in the second jack.

3. The device according to claim 2, wherein the second plug has a flexible attachment to the base which allows the second plug to be removed from the second jack while the second plug is attached to the base.

4. The device according to claim 3, wherein the flexible attachment is a pair of wires which are attached to the base.

5. The device according to claim 3, wherein the flexible attachment is a hinge.

6. The device according to claim 5, wherein the base and the second plug are integrally formed of a single piece of material, and the hinge is a living hinge.

7. The device according to claim 6, further comprising a connector body integrally formed of the same single piece of material as the base and the second plug, the connector body housing terminals for receiving first and second lead wires, the terminals being connected to the contacts of the second plug.

8. The device according to claim 1, wherein the base has at least one integrally mounted spacer on the bottom thereof, the spacer maintaining a predetermined distance between the mounting surface and the printed circuit.

9. The device according to claim 8, wherein the spacer includes means for attaching the base to a printed circuit board on which the printed circuit is located.

10. The device according to claim 8, wherein the mounting surface is the surface of a mounting panel, the base includes a latch at one end of the base and the spacer at the other end of the base.

11. The device according to claim 8, wherein the spacer is formed by a bottom surface of the second jack.

12. The device according to claim 8, wherein the spacer includes means for attaching the spacer to a printed circuit board on which the printed circuit is located.

13. A device, comprising:

a base having a first jack on a bottom of the base and a second jack on a top of the base, the first and second jacks being positioned so that an electrical connection is formed between a first plug and a second plug when the first plug is inserted in the first jack and the second plug is inserted in the second jack, the base having a bearing surface for abutting a mounting surface of an interface unit to which the device is attachable; and at least one spacer integrally attached to the base, the spacer shaped so as to engage a printed circuit board when the bearing surface of the base abuts the mounting surface and the printed circuit board is below the mounting surface.

14. The device according to claim 13, wherein the spacer includes means for fastening the spacer to the printed circuit board simultaneously when the bearing surface engages the mounting surface.

15. The device according to claim 13, wherein the spacer includes means for fastening the spacer to the printed circuit board simultaneously when the bearing surface engages the mounting surface.

16. The device according to claim 13, wherein the first jack and the second jack are next to each other, and an opening is provided between the first and second and the second jack.

17. A method of mounting an interface device in an opening of a panel, comprising steps of:

providing a base having a first jack on a bottom of the base and a second jack on a top of the base, the base having a bearing surface;

inserting a first plug into the first jack, the first plug having terminals which are conductively coupled to the second jack, inserting the base into the opening in the panel to which the interface device is mounted, so that the bearing surface abuts the panel, and said terminals directly connect to a printed circuit below the panel.

18. The method according to claim 17, wherein the step of inserting the base into the opening includes a step of inserting a spacer between the panel and a printed circuit board on which the printed circuit is located.

19. The method according to claim 18, wherein the step of inserting the spacer includes a step of attaching the spacer to the printed circuit board via a fastener integrally formed on the spacer.

20. The method according to claim 17, further comprising the step of inserting a second plug into the second jack, the second plug being electrically connected to a pair of customer terminals.

21. The method according to claim 17, further comprising the step of pivoting a second plug about a pivot point, so that the second plug fits into the second jack.

22. The method according to claim 17, further comprising the step of pivoting a second plug about a living hinge, so that the second plug fits into the second jack.

23. The method according to claim 22, wherein the second plug has a connector attached thereto, the connector having a pair of customer terminals, the method further comprising the steps of:

inserting first and second lead wires into the connector body; and closing a cap of the connector to form conductive paths between the first and second lead wires and the printed circuit.

24. The method according to claim 23, wherein the step of closing the cap includes pivoting the cap about a living hinge which attaches the cap to the connector.

* * * * *